US005086621A

United States Patent [19]

Starner et al.

[11] Patent Number: 5,086,621

[45] Date of Patent: Feb. 11, 1992

[54] OIL RECOVERY SYSTEM FOR LOW CAPACITY OPERATION OF REFRIGERATION SYSTEMS

[75] Inventors: Keith E. Starner; Robert A. Cromis, both of York, Pa.

[73] Assignee: York International Corporation, York, Pa.

[21] Appl. No.: 634,526

[22] Filed: Dec. 27, 1990

[51] Int. Cl.[5] ..... F25B 43/02

[52] U.S. Cl. ..... 62/84; 62/193; 62/471

[58] Field of Search ..... 62/468, 470, 471, 84, 62/193

[56] References Cited

U.S. PATENT DOCUMENTS

| | | | |
|---|---|---|---|
| 1,899,378 | 2/1933 | Zouck et al. | 62/471 X |
| 2,043,917 | 6/1936 | Atchison | 62/471 |
| 2,964,926 | 12/1960 | Ware | 62/471 |
| 3,856,493 | 12/1974 | Bulkley | 62/401 |
| 3,945,216 | 3/1976 | Schibbye | 62/84 |
| 3,945,219 | 3/1976 | Kasahara | 62/469 |
| 4,180,986 | 1/1980 | Shaw | 62/192 |
| 4,187,695 | 2/1980 | Schumacher | 62/503 |
| 4,497,185 | 2/1985 | Shaw | 62/468 |
| 4,715,196 | 12/1987 | Sugura | 62/471 X |

FOREIGN PATENT DOCUMENTS

| | | | |
|---|---|---|---|
| 341799 | 1/1931 | United Kingdom | 62/471 |

*Primary Examiner*—William E. Tapolcai
*Attorney, Agent, or Firm*—Finnegan, Henderson, Farabow, Garrett & Dunner

[57] ABSTRACT

An oil recovery system for refrigeration apparatus of the type in which an oil lubricated screw compressor is oriented with a suction inlet in communication with an evaporated chamber positioned under the compressor so that under conditions of low capacity compressor operation, lubricating oil may fall from the compressor through the suction inlet thereof and into the evaporator. The recovery system takes advantage of an existing suction distribution tray in the upper region of the evaporator chamber of such systems, normally used to assure distribution of gaseous refrigerant to the suction inlet of the compressor, by removing oil dropping into the tray and returning it back to the compressor. An existing by-pass eductor loop for returning liquid refrigerant from the evaporator to the compressor is extended by a valve controlled branch to a second eductor for withdrawing the oil from the tray and returning it to the compressor. The valve is controlled so that the oil recovery system is disabled at normal compressor capacity levels.

12 Claims, 2 Drawing Sheets

OIL RECOVERY SYSTEM FOR LOW CAPACITY OPERATION OF REFRIGERATION SYSTEMS

BACKGROUND OF THE INVENTION

1. Field of the Invention

The present invention relates to an oil recovery method and system for refrigeration apparatus using a screw compressor and, more particularly, to such an oil recovery method and system for low capacity operation of the compressor.

2. Discussion of the Related Art

Oil lubricated screw compressors are commonly used in refrigeration apparatus provided with an oil/refrigerant separator from which oil is fed back to the compressor whereas compressed refrigerant is passed from the separator, through the condenser, through the evaporator units of the system, and back to the suction inlet of the compressor. In certain applications, such as in refrigeration apparatus used for chilling water and other liquids, for example, efficient and compact packaging of the compressor, condenser, evaporator and separator components results in the suction inlet of the compressor opening downwardly to the top of the evaporator chamber. Because the working screws of the compressor are lubricated and in some measure sealed by oil, this geometry of refrigeration components presents a potential for oil dropping from the compressor through the suction opening thereof to the evaporator chamber.

During normal operation of refrigeration apparatus of the type mentioned, the compressor is operated at adequate gas flow through the compressor suction chamber to retain droplets of oil which are present. Under such conditions, the oil separator and recovery system provides adequate management of the oil in the apparatus. At lower compressor capacities, however, the velocity of gases entering the suction chamber of the compressor is reduced to a point where oil from the compressor may drop into the evaporator chamber. If such low capacity operation occurs for any substantial period of time, the oil accumulates in the evaporator and results in reduced efficiency of the refrigeration cycle performed by the apparatus. Also, the supply of oil needed for compressor lubrication may become inadequate.

SUMMARY OF THE INVENTION

An object of the present invention is to provide an oil recovery method and system for screw compressor refrigeration apparatus in which lubricating oil passing from the compressor through the suction inlet thereof to an evaporator chamber is collected and returned directly to the compressor without mixing with refrigerant liquid in the evaporator chamber.

Another object of the invention is to provide such an oil recovery system which involves a minimum of structural revision to existing refrigeration system components.

Still another object of the invention is to provide such an oil recovery method and system which enables a highly efficient refrigeration cycle during high and low capacity operation of the refrigeration compressor and maintains adequate lubrication of the compressor.

Additional objects and advantages of the invention will be set forth in part in the description which follows, and in part will be obvious from the description, or may be learned by the practice of the invention. The objects and advantages of the invention will be realized and attained by means of the elements and combinations particularly pointed out in the appended claims.

To achieve the objects and in accordance with the purpose of the invention, as embodied and broadly described herein, the present invention is especially applicable to refrigeration apparatus having an oil lubricated compressor with a suction inlet opening to the top of an evaporator chamber including a suction trough to control distribution of refrigerant gas passing from the evaporator to the suction inlet of the compressor and comprises a provision for removing oil dropping into the trough during low capacity operation of the compressor and for returning the removed oil directly to the compressor.

In a preferred embodiment of the invention, oil collected in the suction trough located near the top of the evaporator chamber is drained from the trough by a conduit communicating with an eductor through which compressed refrigerant is circulated to draw the oil from the trough. The eductor and associated piping is in addition to an existing eductor used for removing a small flow of liquid refrigerant and oil from the evaporator chamber and returning it to the suction inlet of the compressor for oil return purposes. During low capacity operation of the compressor, the oil recovery system of the invention is enabled so that oil from the trough passes back to the compressor through a port located in the lowest pressure region of the compressor intake. During normal operation of the compressor at higher capacities, the recovery system of the present invention is disabled to ensure efficient operation of the overall refrigeration apparatus.

It is to be understood that both the foregoing general description and the following detailed description are exemplary and explanatory only and are not restrictive of the invention, as claimed.

The accompanying drawings, which are incorporated in and constitute a part of this specification, illustrate an embodiment of the invention and together with the description serve to explain the principles of the invention.

DETAILED DESCRIPTION OF THE PREFERRED EMBODIMENT

Figure 2:
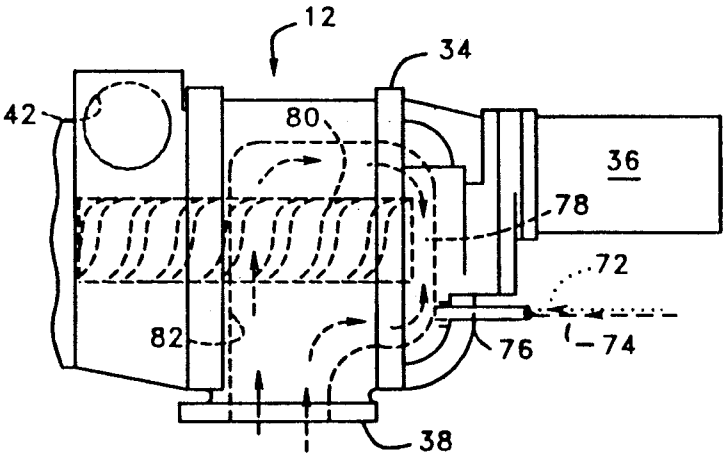
FIG. 2 is an enlarged fragmentary side elevation of the compressor used in the apparatus of FIG. 1.

Reference will now be made in detail to the present preferred embodiment of the invention, an example of which is illustrated in the accompanying drawings. Wherever possible, the same reference numbers will be used throughout the drawings to refer to the same or like parts.

In the illustrated embodiment, the invention is incorporated in a refrigeration apparatus intended for liquid chilling applications and which is designated generally by the reference numeral 10. The major components of the apparatus 10, as well as the relative orientation of those components, are shown most clearly in FIG. 1 and include a compressor 12, an oil separator 14, a condenser 16 and an evaporator 18. The condenser 16 and evaporator 18 are similar in exterior configuration in that both are defined respectively by elongated cylindrical bodies 20 and 22 closed at opposite ends by end plates 24 and 26. The evaporator 22 is further equipped with a manifold 28 on one end plate 26 thereof by which water to be chilled in accordance with the illustrated embodiment is circulated through inlet and outlet conduits 30 and 32, respectively.

Figure 1:
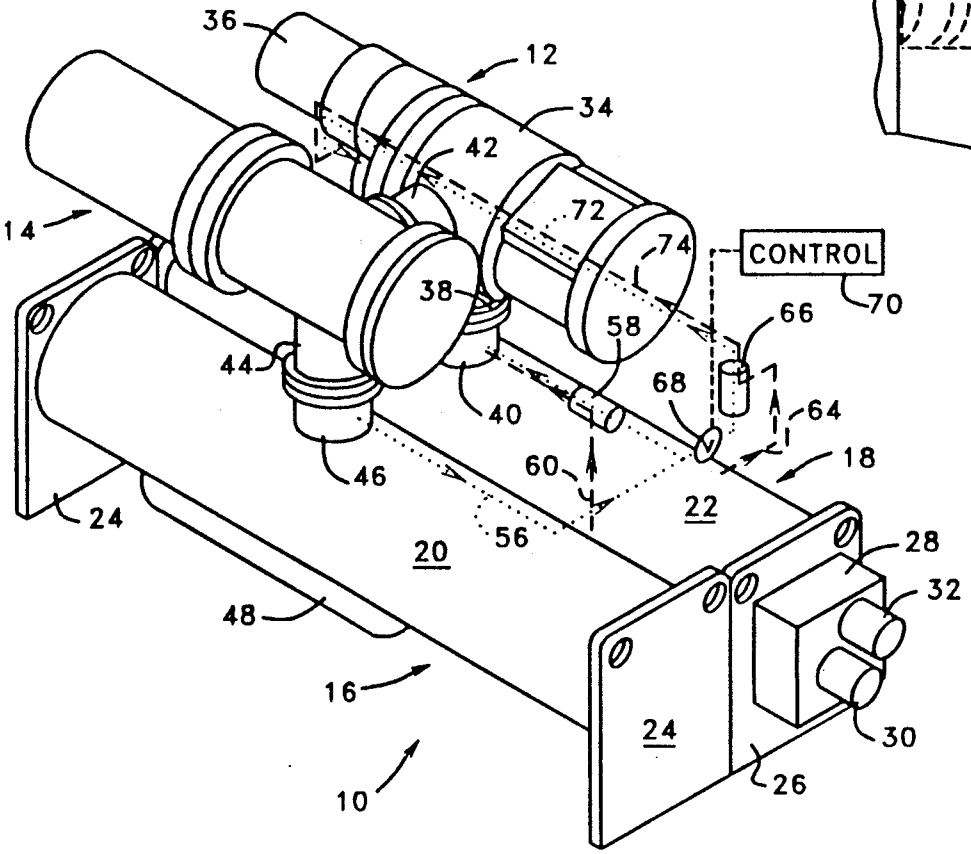
FIG. 1 is a partially schematic perspective view illustrating a refrigeration apparatus including the invention.

As shown generally in FIG. 1, the compressor 12 includes a multi-part exterior casing 34 to which an electric motor 36 is connected at one end for driving the compressor at varying capacities in a manner to be described in more detail below. As shown in FIG. 1, the compressor is located on top of the cylindrical body 22 of the evaporator 18 and includes a suction inlet 38 in communication with a pipe 40 opening through the top of the evaporator 18. A compressor outlet or discharge opening 42 is in direct communication with the separator 14. The separator 14 in the illustrated embodiment is conventional and as such includes a downwardly directed refrigerant conduit 44 in communication with the interior of the condenser body 20 through a conduit 46 opening through the top of the cylindrical body 20 of the condenser 16. The condenser 16, in turn, is in communication with the evaporator 18 by a conduit 48 which opens through and extends from the bottom of both the condenser body 20 and the evaporator body 22.

Figure 3:
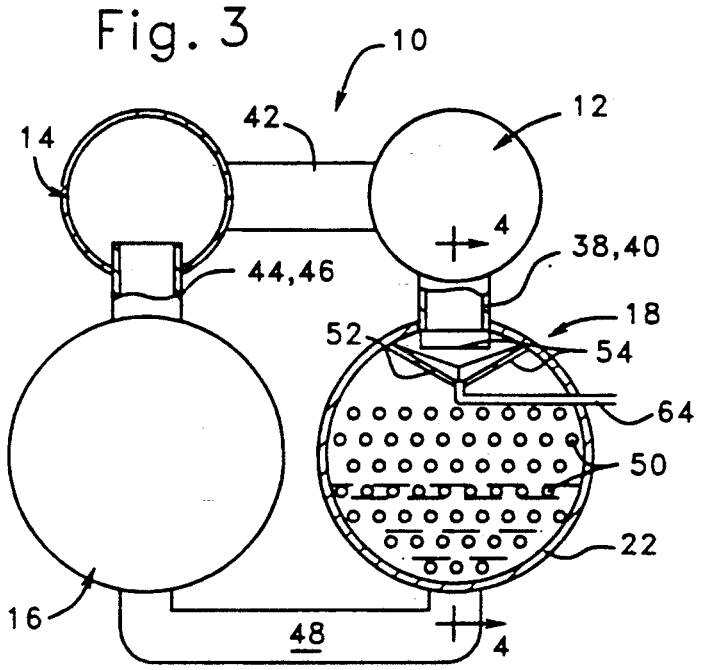
FIG. 3 is a partially schematic fragmentary cross section of the oil separator and evaporator chamber components of the refrigeration apparatus shown in FIG. 1.
Figure 4:
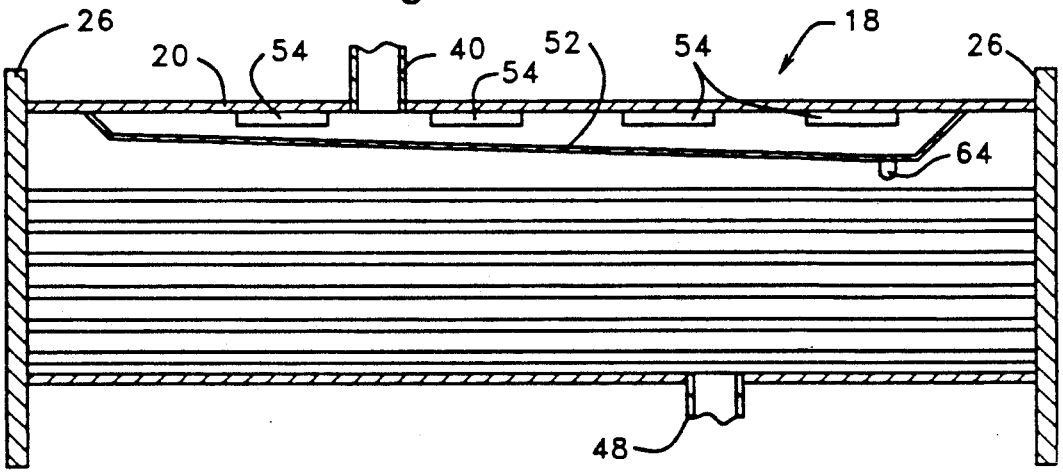
FIG. 4 is a cross section on line 4—4 of FIG. 3.

As shown in FIGS. 3 and 4, the interior of the evaporator body 22 is provided with longitudinal heat exchange tubes 50 for bringing water to be chilled into heat exchange relationship with refrigerant contained the body 22. At the top of the evaporator body interior, an elongated trough 52 is positioned under the conduit 40 in communication with the suction intake 38 of the compressor 12. This trough extends for substantially the length of the evaporator body 20 as shown in FIG. 4 and is provided with spaced window-like openings 54 about the upper marginal edges thereof. The suction trough 52 is conventionally provided in refrigerating apparatus of the type illustrated to control distribution of gas from within the body 22 of the evaporator in passing through the pipe 40 to the suction inlet 38 of the compressor 12. The conventional trough is typically provided with an opening through which any liquid refrigerant collecting in the trough passes to the bottom of the evaporator 18.

The conventional water chilling apparatus further includes a by-pass eductor loop by which liquid refrigerant and oil at the bottom of the evaporator is withdrawn to the suction inlet of the compressor for oil return purposes. In FIG. 1, this eductor loop is shown schematically to include a conduit for high pressure refrigerant extending from the inlet 46 of the condenser 16 to an eductor by which the liquid refrigerant is withdrawn from the evaporator and fed back to the suction inlet of the compressor. Such eductors are well known and operate to aspirate or otherwise draw an educted fluid, the liquid refrigerant and oil in this instance, into a high velocity stream of a driving fluid, i.e., the compressed refrigerant. In FIG. 1, these conduit and eductor components are represented schematically. Specifically, a conduit represented by a dotted line 56 extends from the condenser inlet pipe 46 to an eductor represented by a cylinder 58 and then to the evaporator outlet pipe 40 in communication with the suction inlet of the compressor 12. Liquid refrigerant and oil, represented by a dashed line 60 in FIG. 1, is withdrawn from the evaporator 18 and passed with the high pressure refrigerant back to suction inlet of the compressor 12.

In accordance with the present invention as it is embodied in the illustrated apparatus 10, a provision is made for removing oil which may drop from the compressor 12 under conditions during which the compressor is operated at low capacity. To this end, a drain pipe 64 is fitted to the lower end of the trough 52 in the illustrated embodiment and extends through the body 22 of the evaporator as shown in FIG. 3 of the drawings.

In FIG. 1, the drain pipe 64 is represented by a dashed line 64 to represent the passage of oil through the pipe shown in FIG. 3. As shown further in FIG. 1, the oil passageway extends to a second eductor 66 to which compressed refrigerant is fed through a valve 68. The valve 68 is preferably an electrically controlled valve, such as a solenoid valve, which may be opened or closed by any appropriate control indicated by the legend 70 in FIG. 1.

From the illustration in FIG. 1, it will be appreciated that the refrigerant under pressure supplied to the valve 68 has its origin in the refrigerant line 56 described above with respect to the first eductor 58 for withdrawing liquid from the evaporator 18. In this respect, the compressed refrigerant passing to the second eductor 66 passes through a flow line which may be characterized as a branch or an extension of the eductor by-pass loop including the first eductor 58 and is either operative or inoperative depending on whether the valve 68 is opened or closed.

The mixture of oil and compressed refrigerant passing through a conduit extending from the second eductor 66, represented by dotted and dashed lines 72 and 74 respectively in FIG. 1, is returned to the compressor 12 for recirculation through the apparatus 10. Unlike the return of compressed refrigerant and liquid refrigerant from the evaporator to the suction inlet 38, however, and with reference to FIG. 2 of the drawings, the mixture of compressed refrigerant and oil 72 and 74 is fed directly through a port 76 to the intake end 78 of the working screws 80 of the compressor 12. In this respect, the suction inlet 38 of the compressor 12 opens to a chamber 82 which decreases from a relatively large cross sectional flow area at the mouth of the suction inlet 38 to a passageway of relatively small cross sectional area at the intake end 78 of the screws 80. The pressure decreases from the suction inlet 38 to the inlet end of the screws 80 and reaches a minimum level in the region of the port 76. As a result, the refrigerant flow from the eductor 66 to the compressor 12 is maximized, ensuring efficient operation of the second eductor 66 even under conditions of relatively low capacity operation of the compressor. Also, entry through the port at the intake end avoids direct encounter with the dropping oil in the suction inlet 38.

In the practice of the method of the present invention during operation of the refrigeration apparatus 10, under normal conditions of operation, the compressor 12 is operated above capacities incurring oil dropout. During such normal operation, the velocity of refrigerant gas at the suction inlet 38 of the compressor is adequate to prevent any oil from dropping into the evaporator 18. Also non-working refrigerant bypass for oil return is restricted to that needed for withdrawal of liquid refrigerant from the evaporator 18 by closing the valve 68.

When the capacity of the compressor 12 is reduced to a predetermined level, the valve 68 is opened to remove oil from the trough 52 and return it to the compressor with compressed refrigerant in the manner mentioned above. The control 70 for the valve 68 is, in practice, incorporated as part of an electronic control system (not shown) for monitoring and controlling operation of the refrigeration apparatus 10. Accordingly the valve 68 will be opened only at low capacity conditions and closed under all other conditions of operation. In this way parasitic power loss caused by unneeded high pressure refrigerant by-pass through the second eductor 66 will be minimized. Closure of the valve 68 at greater capacities is important to efficient normal operation of the apparatus 10 where the flow of gaseous refrigerant through the suction inlet 38 prevents oil from passing back to the evaporator 18.

It will be apparent to those skilled in the art that the present invention and in construction of the apparatus hereof without departing from the scope of spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. In a refrigeration apparatus having an oil lubricated compressor with a suction inlet opening to the top of an evaporator including a suction trough to control distribution of refrigerant gas passing from the evaporator to the suction inlet of the compressor, the improvement comprising:

means for removing oil dropping from said suction inlet into said trough during low capacity operation of said compressor; and means for returning the removed oil directly to the compressor.

2. The refrigeration apparatus of claim 1 wherein the suction inlet opens from the bottom of the compressor and includes a region of minimum pressure, and wherein said means for returning the removed oil to the compressor includes a port opening to said region of minimum pressure.

3. The refrigeration apparatus of claim 1 wherein said means for removing said oil includes an eductor and means for directing compressed refrigerant through said eductor.

4. In a refrigeration apparatus having an oil lubricated compressor with a suction inlet opening to the top of an evaporator including a suction trough to control distribution of refrigerant gas passing from the evaporator to the suction inlet of the compressor, the improvement comprising:

means for removing oil dropping into said trough during low capacity operation of said compressor, said means for removing said oil including an eductor and means for directing compressed refrigerant through said eductor;

means for returning the removed oil directly to the compressor; and control means for disabling said eductor during operation of said compressor at normal and higher compressor capacity levels.

5. In a refrigeration apparatus having an oil lubricated compressor with a suction inlet opening to the top of an evaporator including a suction trough to control distribution of refrigerant gas passing from the evaporator to the suction inlet of the compressor, and a compressed refrigerant by-pass loop including a first eductor for returning liquid refrigerant and oil from the evaporator to the compressor, the improvement comprising:

means for removing oil dropping into said trough during low capacity operation of said compressor, said means for removing oil dropping into said trough including a second eductor and means for directing compressed refrigerant through said second eductor; and means for returning the removed oil directly to the compressor.

6. The refrigeration apparatus of claim 5 wherein said means for directing compressed refrigerant through said second eductor includes valve means for enabling and disabling said second eductor.

7. The refrigeration apparatus of claim 6 including control means for operating said valve means to disable said second eductor when operation of the compressor is at normal compressor capacity levels.

8. The method of operating a refrigeration apparatus having an oil lubricated compressor with a suction inlet opening to the top of an evaporator including a suction trough to control distribution of refrigerant gas passing from the evaporator to the suction inlet of the compressor, said method comprising the steps of:

removing oil dropping from the suction inlet into said trough during low capacity operation of said compressor; and returning the removed oil directly to the compressor.

9. The method of claim 8 wherein said removing and returning steps include by-passing a stream of compressed refrigerant back to the compressor and educting the oil from said trough into said stream.

10. The method of operating a refrigeration apparatus having an oil lubricated compressor with a suction inlet opening to the top of an evaporator including a suction trough to control distribution of refrigerant gas passing from the evaporator to the suction inlet of the compressor, said method comprising the steps of:

removing oil dropping into said trough during low capacity operation of said compressor; and returning the removed oil directly to the compressor;

said removing and returning steps including by-passing a stream of compressed refrigerant back to the compressor and educting the oil from said trough into said stream, said stream of compressed refrigerant being by-passed back to the compressor only when the compressor is operated at low compressor capacity level.

11. The method of operating a refrigeration apparatus having an oil lubricated compressor with a suction inlet opening to the top of an evaporator including a suction trough to control distribution of refrigerant gas passing from the evaporator to the suction inlet of the compressor, the compressor including a suction inlet having a region of minimum pressure, said method comprising the steps of:

removing oil dropping into said trough during low capacity operation of said compressor; and returning the removed oil directly to the compressor;

said removing and returning steps including by-passing a stream of compressed refrigerant back to the compressor and educting the oil from said trough into said stream and wherein said compressed refrigerant is by-passed back to said region of minimum pressure.

12. In a refrigeration apparatus having a variable capacity, oil lubricated compressor with a suction inlet opening to the top of an evaporator including a suction trough to control distribution of refrigerant gas passing from the evaporator to the suction inlet of the compressor, the flow of refrigerant from the evaporator upwardly through the suction inlet under normal operating capacity of the compressor preventing lubricating oil from dropping into the evaporator, whereas under low capacity operation of the compressor, oil drops through the suction inlet and into the suction trough, the improvement comprising:

means for removing oil from said trough during low capacity operation of said compressor and for returning the removed oil directly to the compressor.

* * * * *